US008183487B2

(12) United States Patent
Lee

(10) Patent No.: US 8,183,487 B2
(45) Date of Patent: May 22, 2012

(54) CAM AND TWO-LINK LINKAGE OPERATING MECHANISM AND CIRCUIT INTERRUPTER INCLUDING THE SAME

(75) Inventor: Davin Robert Lee, Watertown, WI (US)

(73) Assignee: Eaton Corporation, Cleveland, OH (US)

( * ) Notice: Subject to any disclaimer, the term of this patent is extended or adjusted under 35 U.S.C. 154(b) by 812 days.

(21) Appl. No.: 12/143,209

(22) Filed: Jun. 20, 2008

(65) Prior Publication Data

US 2009/0314620 A1 Dec. 24, 2009

(51) Int. Cl.
*H01H 23/00* (2006.01)

(52) U.S. Cl. ..... 200/401

(58) Field of Classification Search ..... 200/331, 200/401

See application file for complete search history.

(56) References Cited

U.S. PATENT DOCUMENTS 3,600,538 A * 8/1971 Puzas et al. ..... 200/400
5,949,157 A 9/1999 Hirzel

* cited by examiner

*Primary Examiner* — Renee S Luebke
*Assistant Examiner* — Lheiren Mae Caroc
(74) *Attorney, Agent, or Firm* — John A. Kasteric; Martin J. Moran

(57) ABSTRACT

An operating mechanism is provided for a circuit interrupter, such as a battery disconnect apparatus, including a housing and a number of stationary electrical contacts enclosed by the housing. The operating mechanism includes a cam member and a two-bar linkage member having a first bar, a second bar, and a pivot member disposed between the two bars. A movable contact assembly includes at least one movable electrical contact, and is cooperable with the cam member and two-bar linkage member to move the movable electrical contact into and out of electrical contact with the stationary electrical contacts. An actuating assembly pivots the cam member between a first position corresponding to maintaining the movable electrical contact in electrical contact with the stationary electrical contacts; and a second position corresponding to releasing the movable contact assembly in order that the movable electrical contact is movable out of electrical contact with the stationary electrical contacts.

15 Claims, 9 Drawing Sheets

CAM AND TWO-LINK LINKAGE OPERATING MECHANISM AND CIRCUIT INTERRUPTER INCLUDING THE SAME

BACKGROUND OF THE INVENTION

1. Field of the Invention

The invention relates generally to circuit interrupters and, more particularly, to operating mechanisms for circuit interrupters, such as a battery disconnect apparatus.

2. Background Information

Circuit interrupters, such as, for example, battery disconnect switches, are employed to provide protection for the electrical power circuit of a vehicle. For example, some vehicles, such as trucks and cars, employ direct current (DC) disconnecting switches to provide a rapid mechanism to disconnect batteries or other DC power supplies in the event of serious electrical faults. Disconnecting switches may also be employed by vehicles such as, for example, electric vehicles such as golf carts and fork lifts, to disconnect alternating current (AC) power supplies.

Battery cable circuit protection devices, such as battery disconnect devices (BDDs) and battery cut off switches (BCOs), are known to be employed, for example, to disconnect the electrical system (e.g., without limitation, 12 VDC; any suitable DC or AC voltage) of the vehicle in response to a significant collision, or for maintenance during periods of inactivity. Such devices typically employ an operating mechanism having a movable electrical contact which is moved into and out of electrical contact with a number of stationary electrical contacts electrically connected to the battery cable. The movable electrical contact sometimes has a tendency to undesirably separate from the stationary electrical contact(s) when the vehicle is subjected to various shock and vibration loads (e.g., without limitation, rough terrain; pot holes; sudden stops; abrupt turns; collisions). Among other disadvantages, such unintentional separation of the electrical contacts presents an arcing hazard.

Prior proposals have attempted to accommodate such loads by employing an operating mechanism for the battery disconnect device which, for example, has an arrangement of springs, levers and/or solenoids. However, such designs are relatively complex, and thus expensive. Additionally, if the movable electrical contact is brought into electrical contact with the stationary electrical contact(s) too rapidly, it can undesirably bounce with respect to the stationary electrical contact(s), resulting in the undesirable arcing hazard noted above. Solenoids are generally fast-acting and can produce this undesirable result if utilized improperly. Solenoids can also be relatively large, heavy and expensive.

For instance, in some conventional mechanisms, the cam member directly drives the opening and closing of the electrical contacts. As such, the cam member generates the entire force required to move the contacts. Over an extended period of time, the force required of the cam member may cause deformation of the member and thereby, preclude its proper operation.

There is a need, therefore, for an improved operating mechanism for circuit interrupters, such as a battery disconnect apparatus, which not only provides resistance to arcing hazards caused, for example, by unintentional separation of the electrical contacts of the apparatus, but which is also relatively small, lightweight and cost-effective.

There is, therefore, room for improvement in operating mechanisms for circuit interrupters, such as a battery disconnect apparatus.

SUMMARY OF THE INVENTION

These needs and others are met by embodiments of the invention, which provide an operating mechanism for a circuit interrupter, such as a battery disconnect apparatus, wherein the operating mechanism employs a cam member and a two-bar linkage to open and close electrical contacts and to hold the contacts closed. Further, the operating mechanism of the invention resists the electrical contacts of the battery disconnect apparatus from separating unintentionally, for example, in response to shock and vibration loads which are commonly experienced by a vehicle.

Accordingly, the operating mechanism of the invention can provide benefits over related conventional mechanisms known in the art. In the present invention, the cam member cooperates with the two bar linkage to move the electrical contacts. The cam member drives the two-bar linkage and in turn, the linkage drives the contacts. Since the cam member is not directly driving the contacts, a lower force is required of the cam member in order to generate the contact force necessary to open and close the electrical contacts and hold the contacts closed. For example, a two pound force from the cam member to the two-bar linkage would generate about ten pounds of contact force to the electrical contacts. As a result, a fast open and close time of the contacts can be achieved with a lower motor torque, which can allow for a smaller motor, less gearing, and reduced costs.

As one aspect of the invention, an operating mechanism for a circuit interrupter includes a housing and a number of stationary electrical contacts enclosed by the housing. The operating mechanism comprises: a cam member structured to be rotatably coupled to the housing, a two-bar linkage member comprising a first bar, a second bar, and a pivot member disposed between the first bar and the second bar; a movable contact assembly comprising a movable electrical contact, the movable contact assembly being structured to cooperate with the two-bar linkage member to move the movable electrical contact into and out of electrical contact with the number of stationary electrical contacts; and an actuating assembly structured to rotate the cam member between a first position structured to maintain the movable electrical contact of the movable contact assembly in electrical contact with the number of stationary electrical contacts, and a second position being structured to release the movable contact assembly such that the movable electrical contact is movable out of electrical contact with the number of stationary electrical contacts.

As another aspect of the invention, an operating mechanism is provided for a circuit interrupter, which includes a housing and a number of stationary electrical contacts enclosed by the housing. The operating mechanism comprises: a cam member structured to be rotatably coupled to the housing; a two-bar linkage member having a profile, the profile having a first bar and a second bar wherein the first and second bars are connected by a pivot pin; a movable contact assembly comprising a movable electrical contact, the movable contact assembly being structured to cooperate with the linkage member in order to move the movable electrical contact into and out of electrical contact with a number of stationary electrical contacts; and an actuating assembly structured to rotate the cam member between a first position and a second position. In the first position, the cam member cooperates with the two-bar linkage member to move the pivot pin and push the linkage member in an upward direction such that the movable electrical contact of the movable contact assembly is in electrical contact with the number of stationary electrical contacts; and in the second position, the cam member cooperates with the two-bar linkage member such that the pivot pin can move and the opening spring pushes the linkage member in a downward direction to release the movable contact assembly in order that the movable electrical contact is movable out of electrical contact with the number of stationary electrical contacts.

The movable contact assembly may comprise at least one spring element structured to move the movable electrical contact toward and/or away from the number of stationary electrical contacts.

The actuating assembly may comprise a motor and a plurality of gears. A corresponding one of the gears may be coupled to the motor, and each of the gears may have a plurality of teeth. In response to movement of such corresponding one of the gears by the motor, the teeth may be cooperable in order that all of the gears are movable. The gears may comprise a drive gear coupled to the motor, a cam gear coupled to the cam member, and a number of reduction gears disposed intermediate the drive gear and the cam gear. The cam gear can be cooperable with the cam member to rotate the cam member into its first or second position such that the movable electrical contact is in electrical contact with the stationary electrical contacts or the movable electrical contact is released from electrical contact with the stationary electrical contacts, respectively. The actuating assembly may include a means, such as a sensing device or combination of relays, to determine when the cam member is in the first or second position such that the power can be disconnected to prevent further rotation of the cam member once positioned and thus, the open or closed position of the electrical contacts can be maintained.

For example, to open the electrical contacts, power can be applied to a motor which causes the cam member to rotate to a position where the pivot pin of the two-bar linkage member is capable of moving. An opening spring can then push the movable electrical contact and the two-bar linkage member in a lateral direction away from the stationary electrical contacts into their open position. To close the electrical contacts, power can be reapplied to the motor to rotate the cam member against the pivot pin of the two-bar linkage member, pushing the linkage member and the movable electrical contacts in a lateral direction against the stationary electrical contacts to a closed position. Power to the motor then can be disconnected to assure that the cam member remains in its position such that the closed position of the electrical contacts is maintained. A sensing device or a combination of relays can be employed to detect when the electrical contacts are in the closed position and thus, causing the power to the cam member to be disconnected.

Electrical contacts which are in a closed position may be opened in response to a short circuit, arc fault, ground fault or other related conditions. External sensors can be used to detect such conditions and to initiate opening of the electrical contacts by, for example, supplying power to the motor to rotate the cam member to the appropriate position.

BRIEF DESCRIPTION OF THE DRAWINGS

A full understanding of the invention can be gained from the following description of the preferred embodiments when read in conjunction with the accompanying drawings in which:

In FIG. 1A, the operating mechanism is in the open position. In FIG. 1B, the operating mechanism is in the closed position.

In FIG. 2A, the gear is shown and in FIG. 2B, the gear is not shown in order that the profile of the cam member can be shown.

In FIG. 3A, the gear is shown and in FIG. 3B, the gear is not shown in order that the profile of the cam member can be shown.

In FIG. 4A, the gear is shown and in FIG. 4B, the gear is not shown in order that the profile of the cam member can be shown.

In FIGS. 5A, 5E and 5F, the operating mechanism is in the closed position. In FIGS. 5B through 5D and 5G through 5I, the operating mechanism is in the open position.

DESCRIPTION OF THE PREFERRED EMBODIMENTS

Figure 1A:
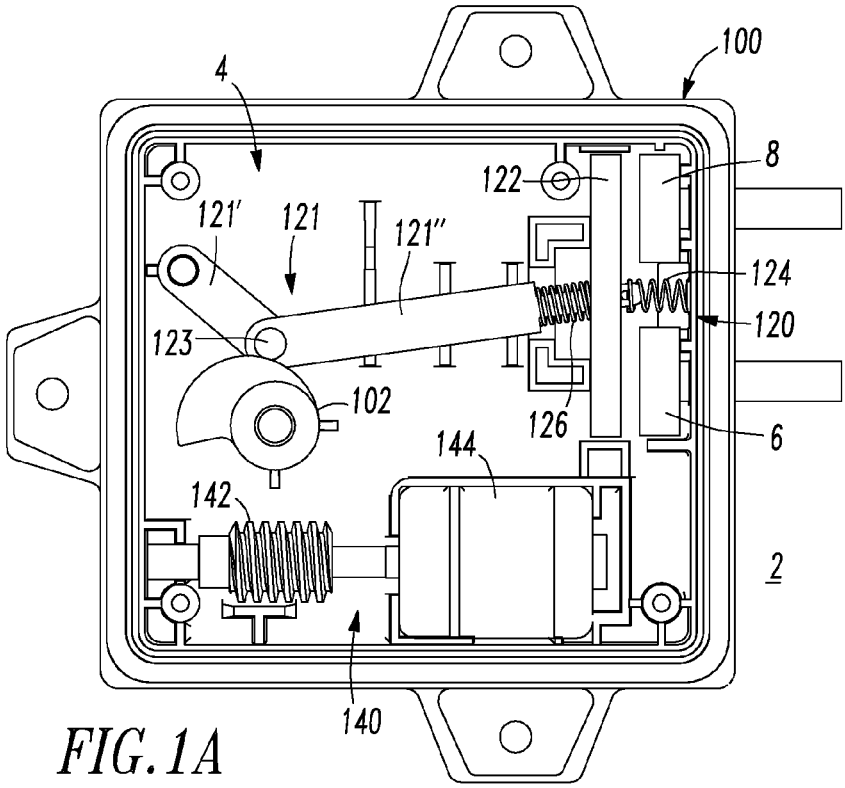
FIGS. 1A and 1B show the battery disconnect apparatus and operating mechanism therefor in accordance with an embodiment of the invention.

The invention is described in association with a battery disconnect apparatus for a vehicle, although the invention is applicable to a wide range of circuit interrupters for direct current (DC) (e.g., without limitation 12 VDC; 24 VDC; 42 VDC; 60 VDC; and any suitable direct current voltage) or alternating current (AC) powered systems.

Directional phrases used herein, such as, for example, left, right, top, bottom, upper, lower, front, back, clockwise, counterclockwise and derivatives thereof, relate to the orientation of the elements shown in the drawings and are not limiting to the claims unless expressly recited therein.

As employed herein, the term "vehicle" shall expressly include, but not be limited by, a land vehicle, a marine vehicle, an air vehicle or another motor vehicle.

As employed herein, the term "land vehicle" shall expressly include, but not be limited by, any land-based vehicles having pneumatic tires, any rail-based vehicles, any maglev vehicles, automobiles, cars, trucks, station wagons, sport-utility vehicles (SUVs), recreational vehicles, construction vehicles, off road vehicles, all-terrain vehicles, farm vehicles, fleet vehicles, motor homes, vans, buses, motorcycles, mopeds, campers, trailers, or bicycles.

As employed herein, the term "marine vehicle" shall expressly include, but not be limited by, any water-based vehicles, ships, boats, other vessels for travel on water, submarines, or other vessels for travel under water.

As employed herein, the term "air vehicle" shall expressly include, but not be limited by, any air-based vehicles, airplanes, jets, aircraft, airships, balloons, blimps, or dirigibles.

As employed herein, the terms "fastener" and "fastening mechanism" refer to any suitable connecting or tightening material or device expressly including, but not limited to, screws, bolts and the combinations of bolts and nuts (e.g., without limitation, lock nuts) and bolts, washers (e.g., without limitation, lock washers) and nuts.

As employed herein, the statement that two or more parts are "coupled" together shall mean that the parts are joined together either directly or joined through one or more intermediate parts.

As employed herein, the term "number" shall mean one or an integer greater than one (i.e., a plurality).

FIGS. 1A and 1B, and 2A and 2B show a battery disconnect apparatus 2 and operating mechanism 100 therefor, which is resistant to shock and vibration experienced by a vehicle (not shown), in accordance with embodiments of the invention. The battery disconnect apparatus 2 includes a housing 4, separable contacts 6, 8, 122 enclosed by the housing 4 and electrically connected between a direct current (e.g., battery-side (positive)) terminal and a load (e.g., load-side (negative)) terminal, and the operating mechanism 100, which is structured to open and close the separable contacts 6, 8, 122. In the example shown and described herein, the separable contacts include a first stationary electrical contact 6 electrically connected to the direct current terminal, a second stationary electrical contact 8 electrically connected to the load terminal, and a movable contact 122 moved by the operating mechanism 100. The battery terminal is electrically connected to the battery (not shown) of the vehicle (not shown), and the load terminal is disposed opposite and spaced from the battery terminal. The separable contacts 6, 8, 122 are thus arranged in a double break configuration. It will, however, be appreciated that any known or suitable alternative number and configuration of separable contacts (e.g., without limitation, a single-break contact configuration; a mechanically held mechanism) (not shown) could be employed, without departing from the scope of the invention. For example, in another embodiment of the invention, the electrical contacts can be arranged in a single-break contact configuration.

The operating mechanism 100 includes cam member 102, which is rotatably coupled to the housing 4. The cam member 102 having a profile cooperates with a two-bar linkage member 121 having links such as for example first bar 121' and second bar 121". The linkage member 121 is pivotably coupled to the housing 4. The first bar 121' has a first end disposed adjacent to the housing 4 and a second end disposed adjacent to a pivot pin 123. The second bar 121" has a first end disposed adjacent to the pivot pin 123 and a second end disposed adjacent to a biasing element 126. The first bar 121' and second bar 121" are pivotally connected at the pivot pin 123.

The operating mechanism 100 includes an actuating assembly 140. As shown in FIG. 2B, the actuating assembly 140 can include at least one actuator 142. In the example shown and described herein, the actuator 142 includes a gear 145 driven by a motor 144 which serves to rotate the cam member 102 in a clockwise or counterclockwise direction. The actuating assembly 140 can further include a plurality of gears (not shown). As previously described, the gear 145 may be coupled to the motor 144 and/or the cam member 102 such that the motor can drive the rotation of the cam member 102 into a first or second position to permit opening and closing of the electrical contacts. As shown from FIG. 1A to FIG. 1B, the actuating assembly 140 can rotate the cam member 102 into a first position (FIG. 1B) corresponding to the movable electrical contact 122 being in electrical contact with the stationary electrical contacts 6,8 in their closed position. As shown in FIG. 2A and FIG. 2B, the actuating assembly 140 can rotate the cam member 102 into a second position such that the movable electrical contact 122 is released and out of electrical contact with the stationary electrical contacts 6,8 in an open position.

Figure 1B:
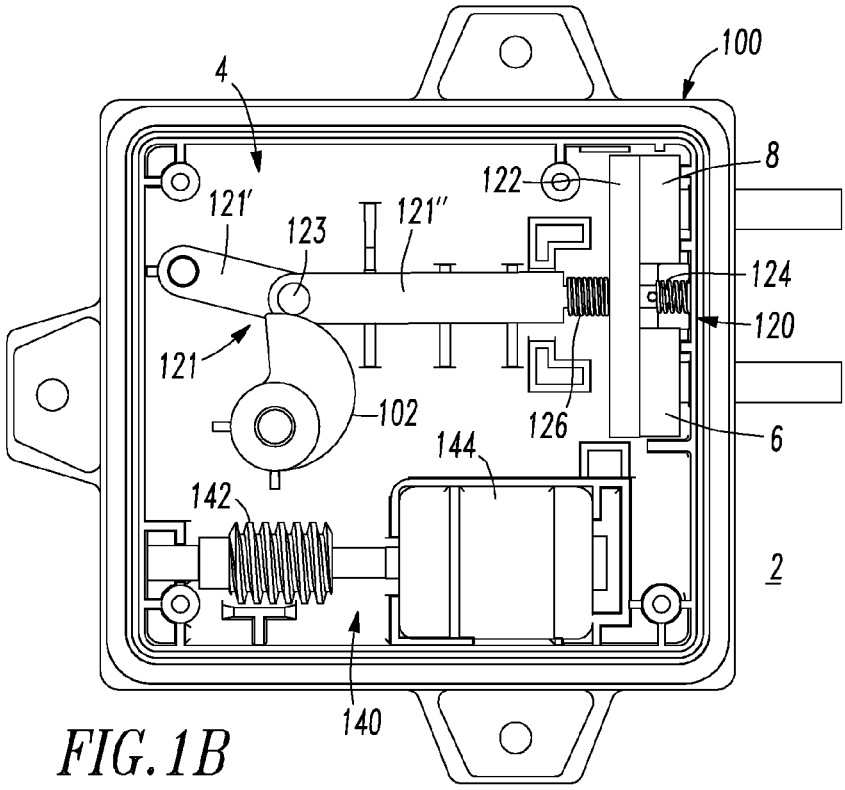
Figure 2A:
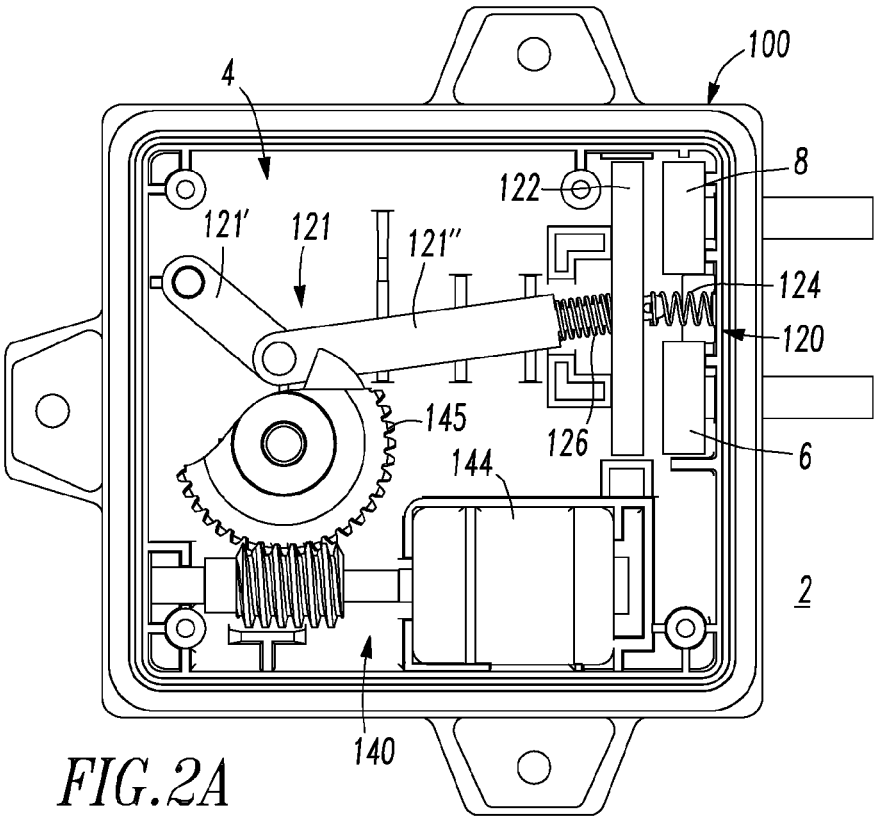
FIGS. 2A and 2B show the battery disconnect apparatus and operating mechanism therefor in accordance with an embodiment of the invention, wherein the operating mechanism is in an open position.
Figure 2B:
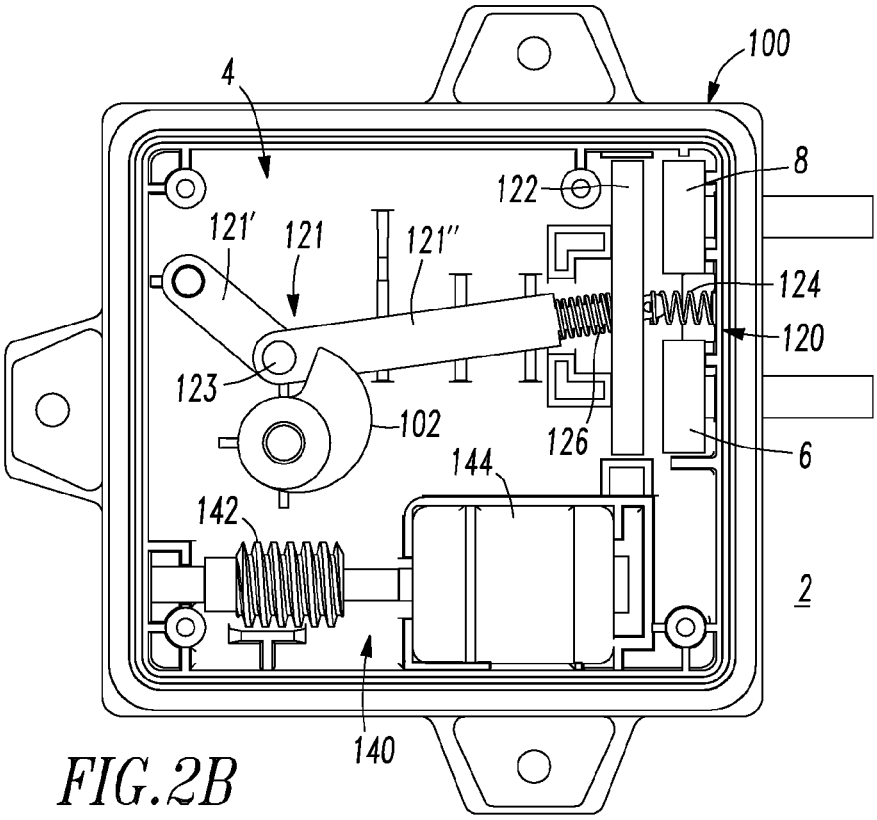

As shown in FIG. 1A, when the cam member 102 is being rotated into a first position to start closing the electrical contacts, the pivot pin 123 of the linkage member 121 cooperates with the profile of the cam member 102 to move the first and second bars 121',121" of the linkage member 121. The cam member 102 pushes the pivot pin 123 in an upward (with respect to FIG. 1A) direction and the linkage member 121 is moved in a lateral direction. As shown in FIG. 1B, when the cam member 102 is positioned such that the electrical contacts are closed, the pivot pin 123 is engaged to prevent the cam member 102 and the movable contact assembly 120 from moving.

As shown in FIGS. 2A and 2B, to open the electrical contacts 6, 8, 122, the cam member 102 is rotated into a second position such that the profile of the cam member 102 disengages from the pivot pin 123 and causes the linkage member 121 to pivot such that the second bar 121" is displaced by spring member 126, thereby moving the pivot pin 123 and the movable electrical contact 122 such that the movable electrical contact 122 is thus moved out of electrical contact with the stationary electrical contacts 6, 8.

The operating mechanism 100 further includes the movable contact assembly 120, which includes the aforementioned movable electrical contact 122, and cooperates with the cam member 102 in order to move the movable electrical contact 122 into and out of electrical contact with the stationary electrical contacts 6,8. The movable contact assembly 120 includes at least one biasing element 124, which is structured to bias the movable electrical contact 122 away from the stationary electrical contacts 6,8. In the example described herein, the biasing element 124 comprises an opening spring 124 which is disposed between the housing 4 of the battery disconnect apparatus 2 and the movable electrical contact 122. The movable contact assembly 120 can further include a second biasing element 126. In the example described herein, the second biasing element 126 comprises a compression spring which biases the movable electrical contact 122 against the stationary electrical contacts 6,8 in the closed position (FIG. 1B). The bias elements 124,126 allow for a substantially consistent force to be provided to the contacts. The compression spring 126 is disposed between the second end of the second bar 121" of the linkage member 121 and the movable electrical contact 122.

Figure 3B:
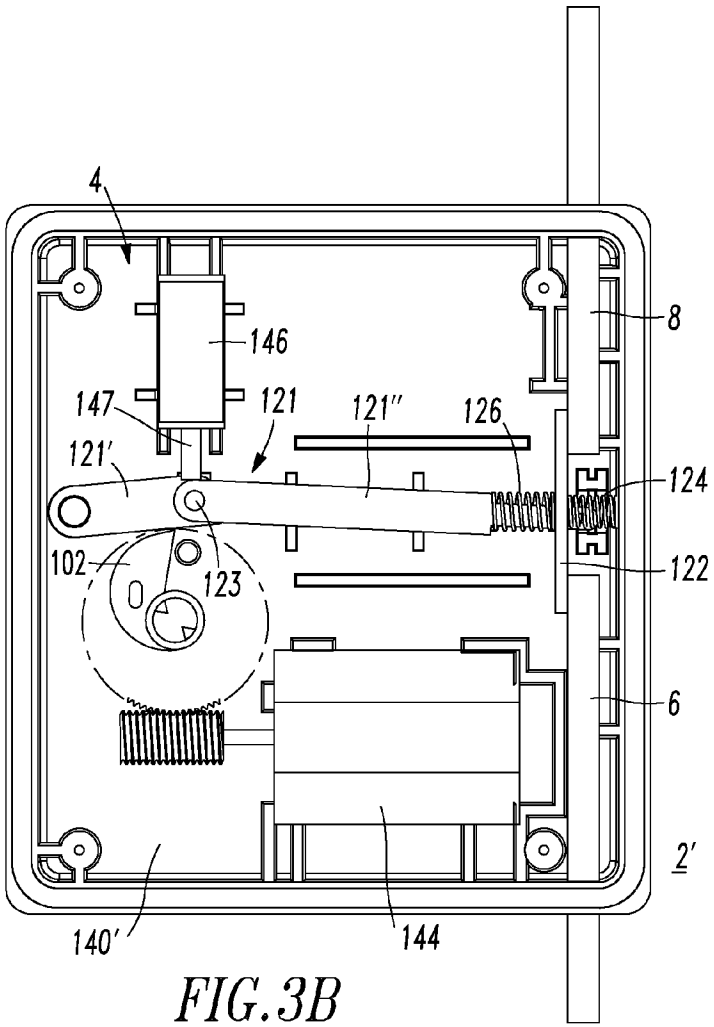
FIGS. 3A and 3B show the battery disconnect apparatus and operating mechanism therefor in accordance with an embodiment of the invention wherein a solenoid is employed as an actuator, and the operating mechanism is in a closed position.
Figure 3A:
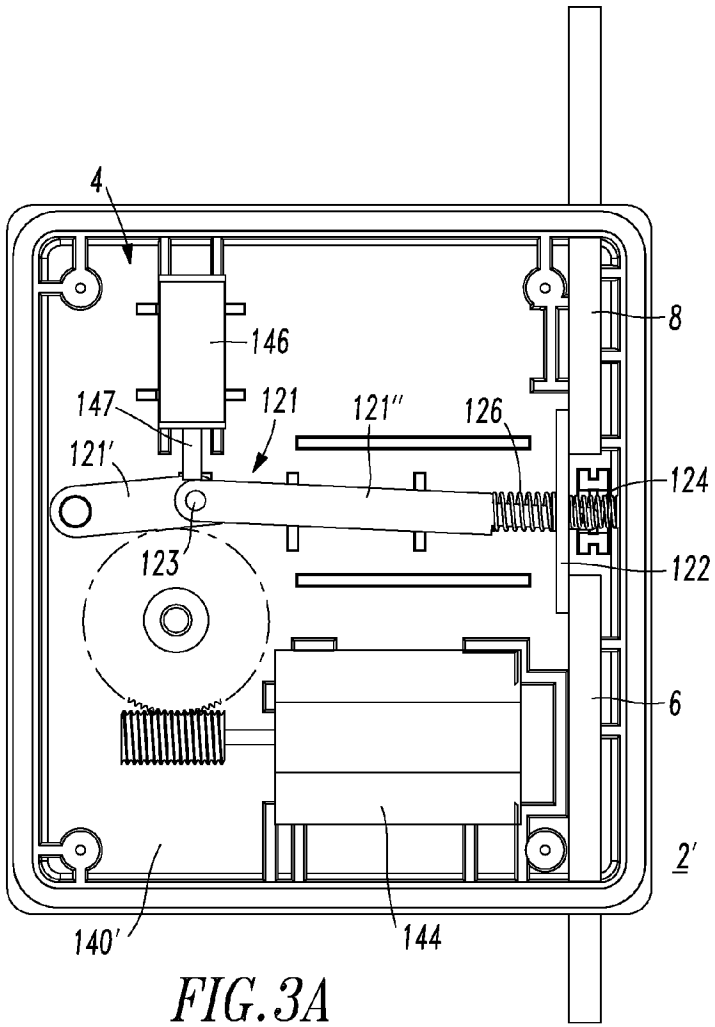
Figure 4B:
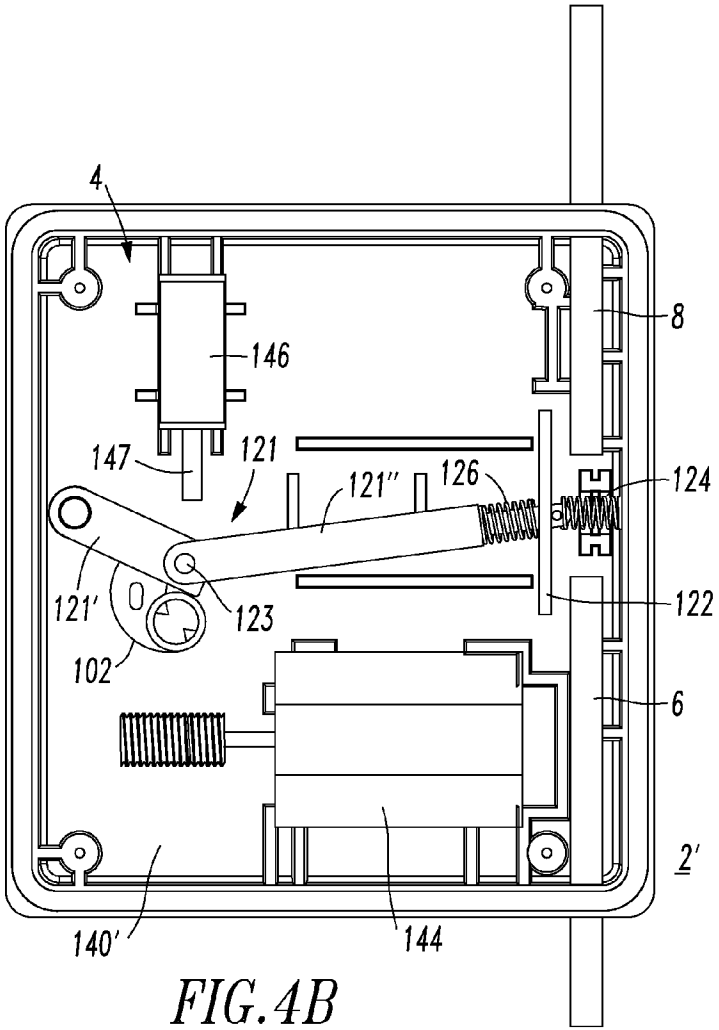
FIGS. 4A and 4B show the battery disconnect apparatus and operating mechanism therefor in accordance with an embodiment of the invention wherein a solenoid is employed as an actuator, and the operating mechanism is in an open position.
Figure 4A:
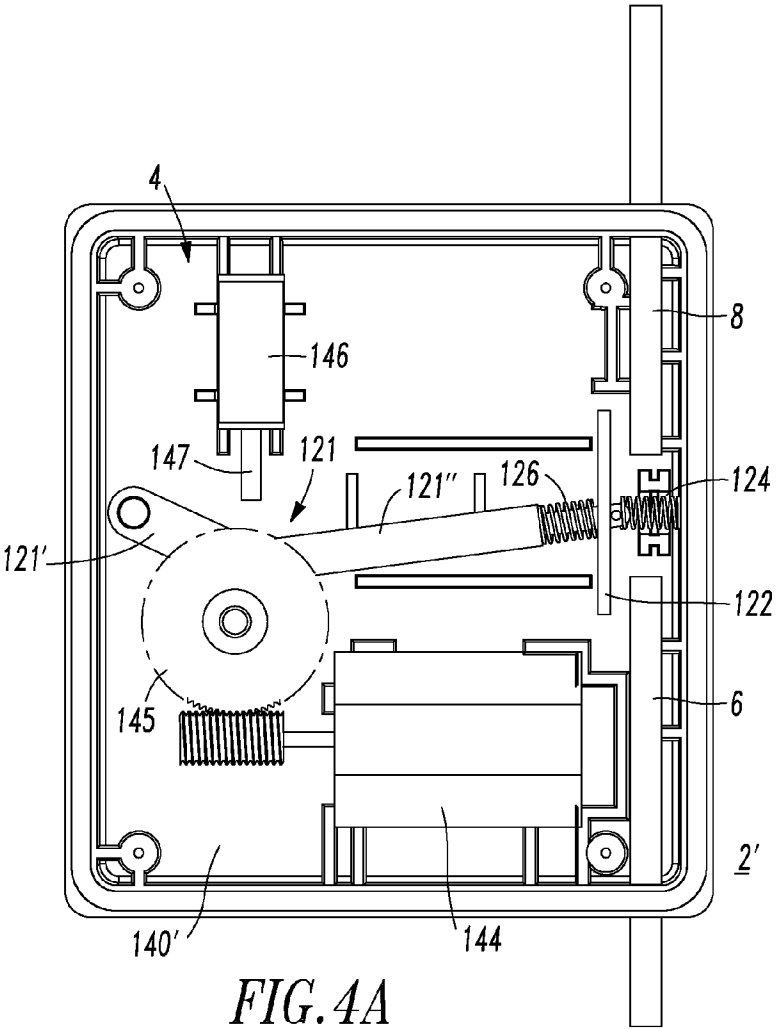

As shown in FIGS. 3A-3B and FIGS. 4A-4B, an actuating assembly 140' may further comprise a solenoid 146 as an actuator. In this example, the solenoid 146 is disposed adjacent to the housing 4 of the battery disconnect apparatus 2' and is structured to cooperate with the pivot pin 123. The solenoid 146 can include a plunger 147. The solenoid 146 can be structured to move the plunger 147, thereby cooperating with the pivot pin 123 of the two-bar linkage member 121 to move the movable electrical contact 122 away from the stationary electrical contacts 6,8 such that the operating mechanism is in an open position (as shown in FIGS. 4A-4B).

As shown in FIGS. 3A and 3B, to close the electrical contacts 6, 8, 122, the motor 144 is engaged to rotate the cam member 102 such that it pushes the pivot pin 123 of the two-bar linkage member 121 in an upward direction, which cooperates to move the linkage member 121 laterally, thereby compressing the spring 126 and causing the movable electrical contact 122 to move toward the stationary electrical contacts 6, 8, to effect a closed position, as shown. The two-bar linkage member 121 is moved by the cam member 102 such that the linkage member 121 pushes against the solenoid plunger 147 to maintain a stable, closed position. A sensing mechanism (not shown), such as an electrical sensing device or a combination of relays, can be employed to disconnect the motor 144 when the closed position of the electrical contacts 6,8,122 is reached in order to maintain the cam member 102 in its position.

Another sensing mechanism (not shown), such as an electrical sensing device or a combination of relays, can be employed to generate a signal when it is needed to open the contacts from the closed position. For example, a sensor (not shown) can be used to detect an arc fault, ground fault or short circuit. Upon detection, a fast opening can be provided by the sensor causing power to be supplied to the solenoid 146 such that the plunger 147 is pushed downward against the two-bar linkage member 121, causing the two-bar linkage member 121 to be pushed beyond its horizontal center point, and allowing the spring then to be engaged to fully open the electrical contacts 6,8,122. As shown from FIG. 3B to FIG. 4B, in this embodiment, the cam 102 does not rotate and maintains its position such that the solenoid 146 an be engaged to cooperate with the two-bar linkage member 121.

As shown from FIGS. 3A and 3B to FIGS. 4A and 4B, to open the electrical contacts 6, 8, 122, the power is applied to solenoid 146, the cam member 102 being in a position that allows the solenoid plunger 147 to push downward (with respect to FIGS. 4A and 4B) against the pivot pin 123 which allows the spring 124 to decompress and move the two-bar linkage member 121 and electrical contacts 6, 8, 122 into their open position. A sensing mechanism (not shown), such as an electrical sensing device or a combination of relays, can be employed to disconnect the solenoid 144 when the open position of the electrical contacts 6,8,122 is reached.

As shown in FIGS. 5A through 5I, a lever 10 can be employed to manually open and close the electrical contacts 6, 8, 122. The lever 10 can be disposed between the housing 4 of the battery disconnect apparatus 2" and the first end of the first bar 121' of the two-bar linkage member. The lever can be pivotably connected to the first bar 121' by pivot pin 123'.

Figure 5A:
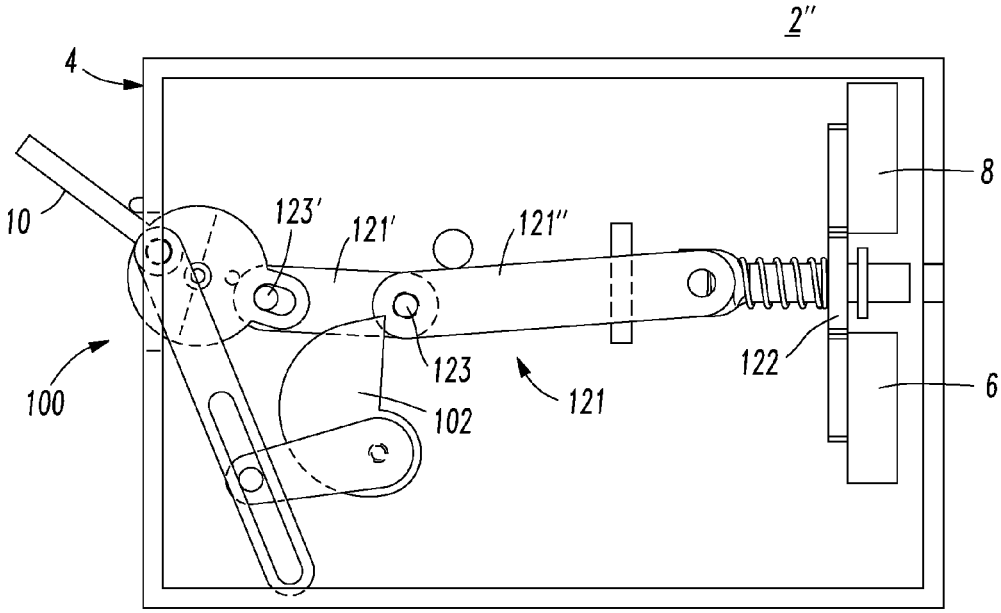
FIGS. 5A through 5I show the battery disconnect apparatus and operating mechanism therefor in accordance with an embodiment of the invention wherein a lever is shown which can be employed to manually move the electrical contacts.

As shown in FIG. 5A, the lever 10 can be positioned in an upward direction (with respect to FIG. 5A) to cooperate with the cam member 102 and the two-bar linkage member 121 to push the movable electrical contact 122 against the stationary electrical contacts 6,8 to effect a closed position.

Figure 5B:
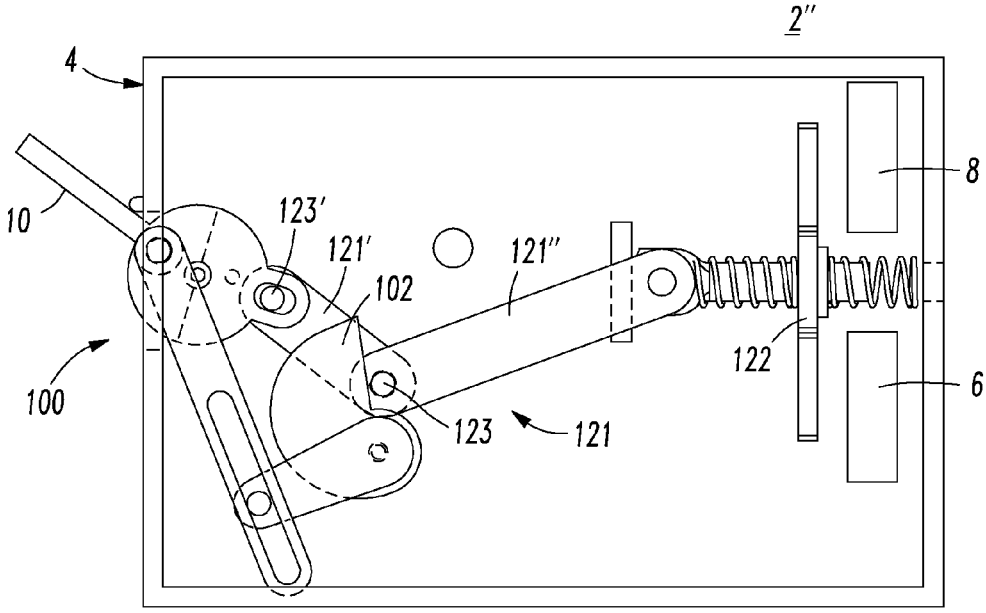
Figure 5C:
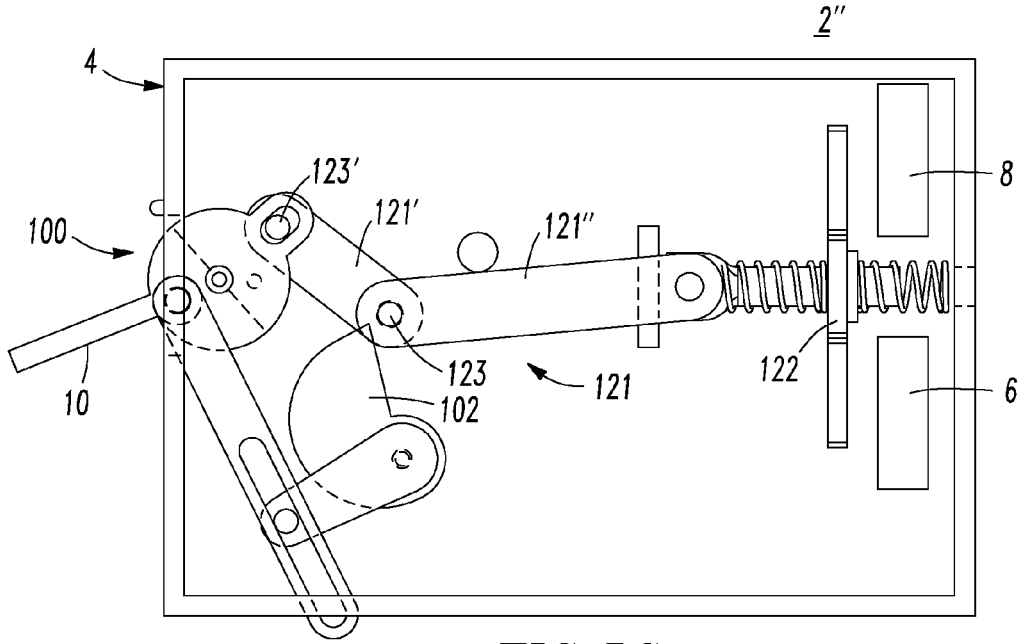

As shown in FIGS. 5B and 5C, the motor (not shown) can rotate the cam member 102 in a direction which causes the two-bar linkage to disengage at pivot pin 123 and in turn allows the movable electrical contact 122 to move away from stationary electrical contacts 6,8 to effect an open position. In FIG. 5B, the lever 10 can remain in an upward position (with respect to FIGS. 5A and 5B) In FIG. 5C, the torsion spring 128 can cause the lever 10 to be moved in a downward direction (with respect to FIGS. 5A and 5B) to provide a visual indication that the electrical contacts 6,8,122 are in an open position. Such indication can be particularly useful for circuit breaker-type devices.

Figure 5D:
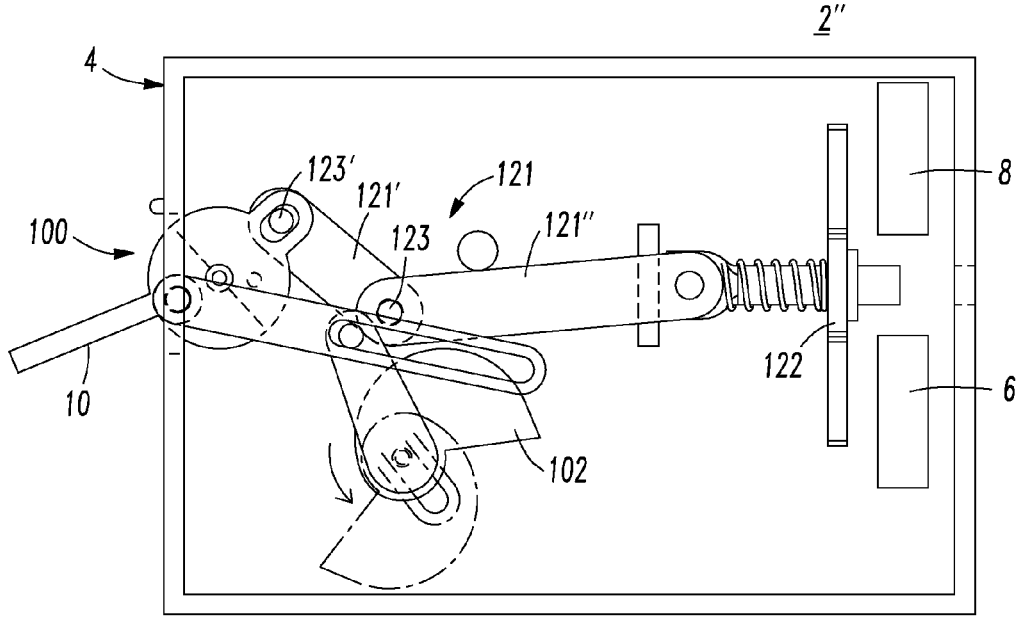
Figure 5E:
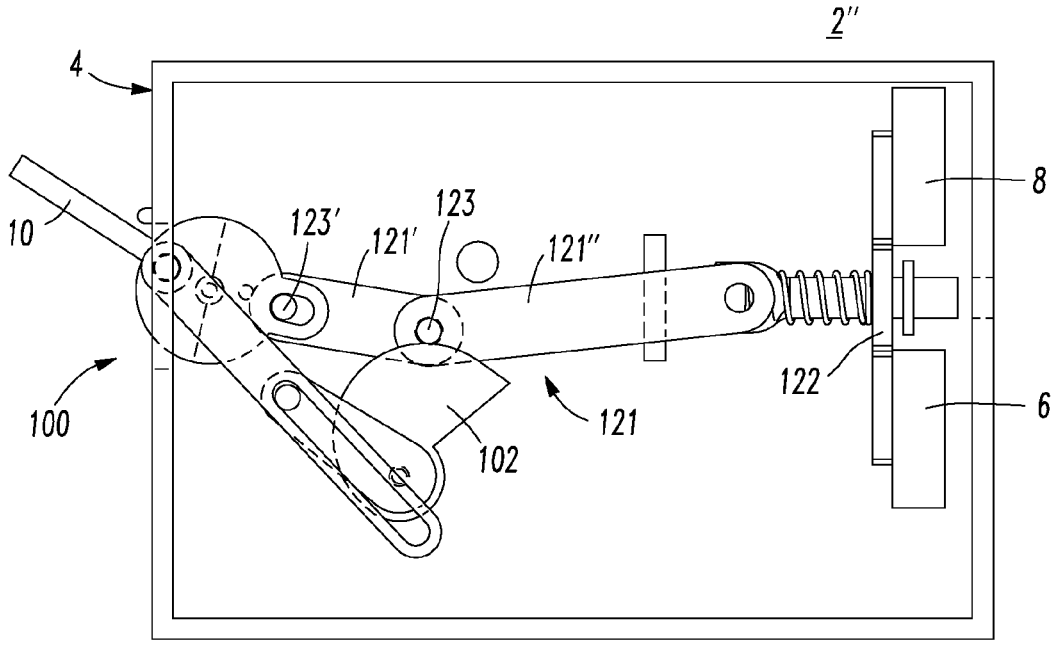

As shown in FIGS. 5D and 5E, the lever 10 can be pushed from a downward position to an upward position (with respect to FIGS. 5D and 5E) when the cam member 102 is rotated accordingly to effect moving of the electrical contacts 6,8,122 from an open to a closed position. In this embodiment, the cam member 102 can be rotated in a counterclockwise direction (with respect to FIGS. 5D and 5E) to cooperate with the two-bar linkage causing the two-bar linkage to move upward into an essentially linear position, thereby causing the movable electrical contact 122 to move against the stationary electrical contacts 6,8 to effect a closed position.

Figure 5F:
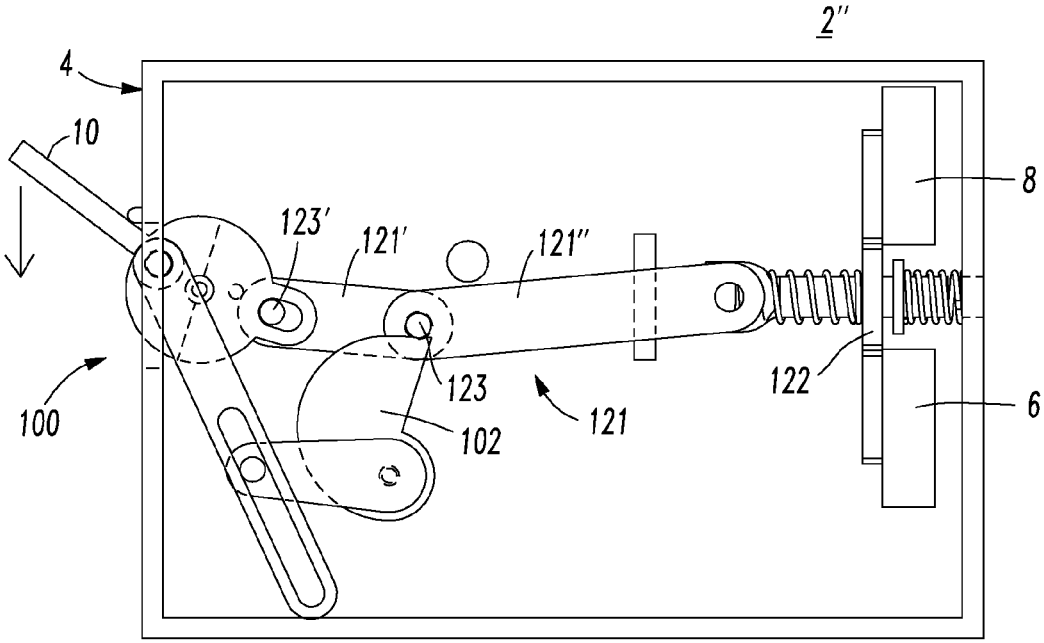
Figure 5G:
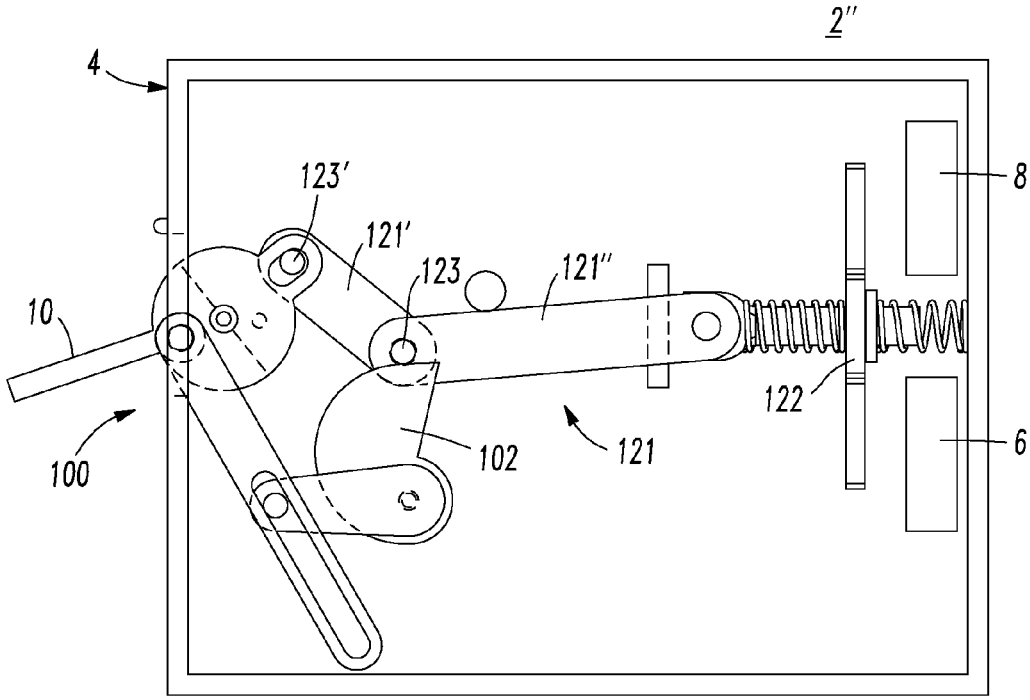

As shown in FIGS. 5F and 5G, the lever 10 can be pushed downwardly to cooperate with the two-bar linkage 121 such that the first bar 121' rotates in an upwardly direction allowing the movable electrical contact 122 to move away from the stationary electrical contacts 6,8 to effect an open position. Movement of the lever to effect the open position is accomplished without rotating the cam member 102.

Figure 5H:
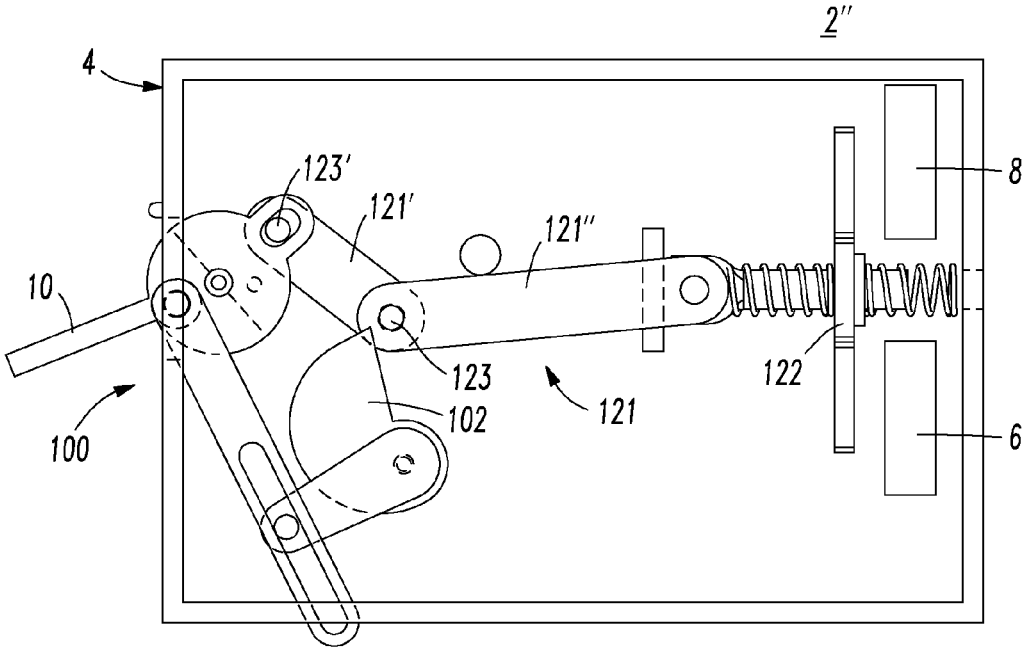
Figure 5I:
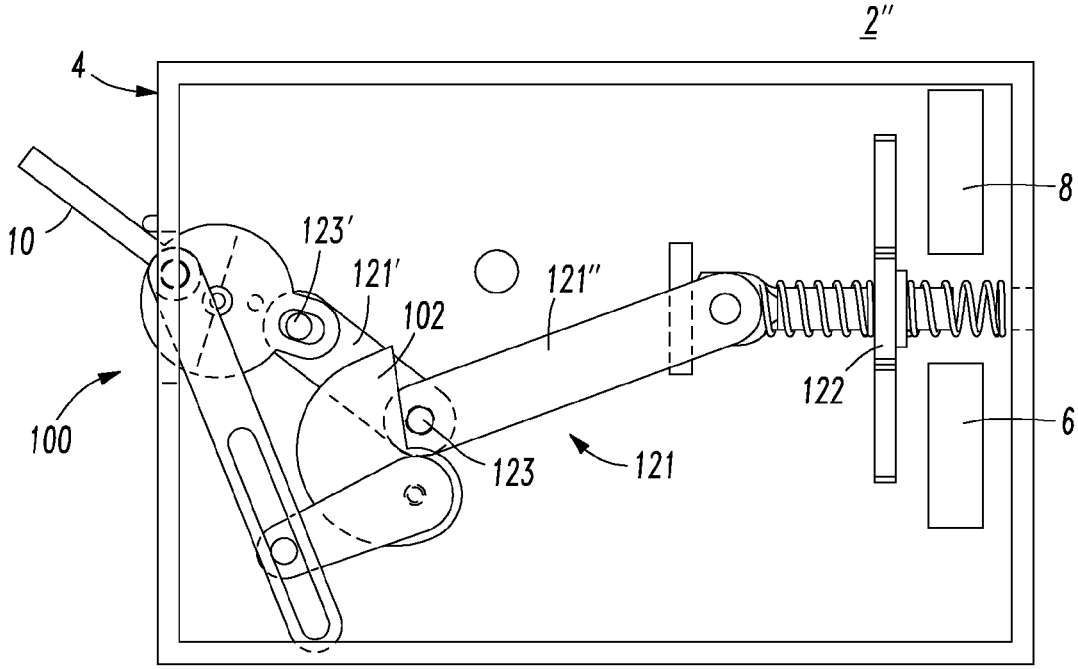

As shown in FIGS. 5H and 5I, the lever 10 may not be operable to move the electrical contacts 6,8,122. For example, when a sensor (not shown) detects a condition (e.g., an arc fault, ground fault or short circuit) which requires the electrical contacts 6,8,122 to be in an open position, the sensor generates a signal to open the electrical contacts 6,8, 122. In response to the signal, the motor 144 (FIG. 1B) supplies power to drive the cam member 102. The cam member 102 rotates to a position that allows electrical contact 122 to move away from the stationary electrical contacts 6,8 and to effect an open position. With respect to FIG. 5H, the electrical contacts are in an open position and the lever 10 can be in a downward position. With respect to FIG. 5I, lever 10 can be pushed upwardly and the electrical contacts remain in the open position. Pushing lever 10 upwardly does not result in closing of the electrical contacts 6,8,122 and therefore, does not override the signal generated to open the electrical contacts 6,8,122. This embodiment can be particularly useful for circuit breaker devices.

Accordingly, the disclosed operating mechanism 100 employs a unique cam member 102, two-bar linkage member 121, movable contact assembly 120, and actuating assembly 140 to provide a relatively small, lightweight and cost-effective mechanism for effectively operating (e.g., opening and closing) the separable contacts 6, 8, 122 of the battery disconnect apparatus 2,2',2" while resisting arcing hazards commonly associated with shock and vibration loads experienced by a vehicle.

While specific embodiments of the invention have been described in detail, it will be appreciated by those skilled in the art that various modifications and alternatives to those details could be developed in light of the overall teachings of the disclosure. Accordingly, the particular arrangements disclosed are meant to be illustrative only and not limiting as to the scope of the invention which is to be given the full breadth of the claims appended and any and all equivalents thereof.

What is claimed is:

1. An operating mechanism for a circuit interrupter including a housing and a number of stationary electrical contacts enclosed by said housing, said operating mechanism comprising:

a cam member structured to be rotatably coupled to said housing;

a two-link linkage member comprising a first link, a second link, and a pivot member disposed between said first link and said second link, said cam member rotating directly against said pivot member;

a movable contact assembly comprising a movable electrical contact, said movable contact assembly being structured to cooperate with said two-link linkage member to move said movable electrical contact into and out of electrical contact with said number of stationary electrical contacts; and an actuating assembly structured to rotate said cam member between a first position structured to maintain said movable electrical contact of said movable contact assembly in electrical contact with said number of stationary electrical contacts, and a second position being structured to release said movable contact assembly such that said movable electrical contact is movable out of electrical contact with said number of stationary electrical contacts.

2. The operating mechanism of claim 1 wherein said movable contact assembly further comprises at least one biasing element structured to bias said movable electrical contact away from said number of stationary electrical contacts.

3. The operating mechanism of claim 2 wherein said at least one biasing element comprises an opening spring; and wherein said opening spring is structured to be disposed between said housing and said movable electrical contact.

4. The operating mechanism of claim 1 wherein said actuating assembly comprises at least one actuator.

5. The operating mechanism of claim 4 wherein said at least one actuator comprises a motor; and wherein said actuating assembly further comprises a plurality of gears.

6. The operating mechanism of claim 4 wherein said at least one actuator comprises a solenoid; wherein said solenoid includes a plunger; and wherein said plunger is structured to be disposed between said housing and said pivot member of said linkage member.

7. An operating mechanism for a circuit interrupter including a housing and a number of stationary electrical contacts enclosed by said housing, said operating mechanism comprising:

a cam member structured to be rotatably coupled to said housing;

a two-link linkage member comprising a first link, a second link, and a pivot member disposed between said first link and said second link;

a movable contact assembly comprising a movable electrical contact and at least one biasing element structured to bias said movable electrical contact away from said number of stationary electrical contacts, said movable contact assembly being structured to cooperate with said two-link linkage member to move said movable electrical contact into and out of electrical contact with said number of stationary electrical contacts; and an actuating assembly structured to rotate said cam member between a first position structured to maintain said movable electrical contact of said movable contact assembly in electrical contact with said number of stationary electrical contacts, and a second position being structured to release said movable contact assembly such that said movable electrical contact is movable out of electrical contact with said number of stationary electrical contacts, wherein said at least one biasing element comprises a compression spring, and wherein said compression spring is structured to be disposed between said second link of said linkage member and said movable electrical contact.

8. A circuit interrupter comprising:

a housing;

separable contacts enclosed by said housing, said separable contacts including a number of stationary electrical contacts and at least one movable electrical contact; and an operating mechanism comprising:

a cam member rotatably coupled to said housing;

a two-link linkage member comprising a first link, a second link, and a pivot member disposed between said first link and said second link, said cam member rotating directly against said pivot member;

a movable contact assembly comprising a movable electrical contact, said movable contact assembly cooperating with said two-link linkage member to move said movable electrical contact into and out of electrical contact with said number of stationary electrical contacts; and an actuating assembly rotating said cam member between a first position structured to maintain said movable electrical contact of said movable contact assembly in electrical contact with said number of stationary electrical contacts, and a second position structured to release said movable contact assembly such that said movable electrical contact is movable out of electrical contact with said number of stationary electrical contacts.

9. The circuit interrupter of claim 8 wherein said movable contact assembly further comprises at least one biasing element.

10. The circuit interrupter of claim 8 wherein said actuating assembly comprises at least one actuator.

11. The circuit interrupter of claim 10 wherein said at least one actuator comprises a motor; and wherein said actuating assembly further comprises a plurality of gears.

12. The circuit interrupter of claim 10 wherein said at least one actuator comprises a solenoid; wherein said solenoid includes a plunger; and wherein said plunger is disposed between said housing and said pivot member of said linkage member.

13. The circuit interrupter of claim 8 wherein said circuit interrupter is a battery disconnect apparatus; wherein said number of stationary electrical contacts comprise a battery terminal and a load terminal; wherein said at least one movable electrical contact is a single movable electrical contact; and wherein said battery terminal, said load terminal and said single movable electrical contact are arranged in a double break configuration.

14. An operating mechanism for a circuit interrupter including a housing and a number of stationary electrical contacts enclosed by said housing, said operating mechanism comprising:

a cam member structured to be rotatably coupled to said housing;

a two-link linkage member comprising a first link, a second link, and a pivot member disposed between said first link and said second link, said cam member rotating directly against said pivot member;

a movable contact assembly; and a lever structured to be manually moved in a first direction or an opposite second direction to cooperate with said cam member and/or said two-link linkage member to move said movable contact assembly, said movable contact assembly comprising a movable electrical contact, said movable contact assembly being structured to cooperate with said two-link linkage member to move said movable electrical contact into and out of electrical contact with said number of stationary electrical contacts.

15. An operating mechanism for a circuit interrupter including a housing and a number of stationary electrical contacts enclosed by said housing, said operating mechanism comprising:

a cam member structured to be rotatably coupled to said housing;

a two-link linkage member comprising a first link, a second link, and a first pivot member disposed between said first link and said second link;

a movable contact assembly; and a lever pivotally connected to the first link by a second pivot member, said lever structured to be manually moved in a first direction or an opposite second direction to cooperate with said cam member and/or said two-link linkage member to move said movable contact assembly, said movable contact assembly comprising a movable electrical contact, said movable contact assembly being structured to cooperate with said two-link linkage member to move said movable electrical contact into and out of electrical contact with said number of stationary electrical contacts.

* * * * *